US005564630A

United States Patent [19]

Giles et al.

[11] Patent Number: 5,564,630

[45] Date of Patent: Oct. 15, 1996

[54] ACCELERATION ARRANGEMENT FOR AIRLAY TEXTILE WEB FORMERS

[75] Inventors: Andrew J. Giles, Joelton; Robert E. Morgan, Hendersonville; Phillip O. Staples, Nashville, all of Tenn.

[73] Assignee: E. I. Du Pont de Nemours and Company, Wilmington, Del.

[21] Appl. No.: 259,722

[22] Filed: Jun. 14, 1994

[51] Int. Cl.[6] ..... B05B 1/02

[52] U.S. Cl. ..... 239/8; 19/304; 239/590; 239/594; 406/70; 406/82; 406/194

[58] Field of Search ..... 239/597, 599, 239/589, 590, 592–594, 8; 19/296, 304; 406/69, 70, 82, 108, 144, 194

[56] References Cited

U.S. PATENT DOCUMENTS 3,768,120 10/1973 Miller .
3,797,074 3/1974 Zafiroglu .
4,489,462 12/1984 Dodson, Jr. ..... 19/296
4,622,714 11/1986 Tomasello ..... 239/597
5,007,137 4/1991 Graute ..... 19/304

OTHER PUBLICATIONS

Paul Dybro, Winds of Change, *Sportscar,* 59 and 60, Jun., 1994.

Victor L. Streeter, Editor–in–Chief, Turbulence, *Handbook of Fluid Dynamics*—Oct. 31, 1961.

*Primary Examiner*—Andres Kashnikow

[57] ABSTRACT

This invention relates to an improved air acceleration nozzle for use in airlay web formers which reduce the creation of large scale vortices and turbulence. The nozzle accelerates the air by reducing the cross sectional area of the conduit. The size of the conduit for the air is reduced in both lateral dimensions, and more preferably, both dimensions are reduced with smoothly curving, low angle peripheral walls.

9 Claims, 4 Drawing Sheets

ACCELERATION ARRANGEMENT FOR AIRLAY TEXTILE WEB FORMERS

FIELD OF THE INVENTION

This invention relates to systems and processes for the dry laying or forming of a web of textile fibers commonly called airlay web formers, and more particularly to the systems and processes for providing the air to the airlay web formers.

BACKGROUND AND SUMMARY OF THE INVENTION

In the airlay web forming process in use by E.I. du Pont de Nemours and Company (DuPont) in the manufacture of spunlaced fabrics sold under the trademark Sontara®, fiber is carried by a relatively fast moving air stream to a screen conveyor forming a web of randomly arranged fibers. The commercial process is disclosed and described in U.S. Pat. No. 3,797,074 to Zafiroglu. While the Zafiroglu arrangement has been in successful use for a number of years, the webs formed thereby are generally not uniform, and the edges are often completely unacceptable. At the edges, as much as six to eight inches at both sides must be separated and removed from the web because of the irregularities and defects which will lead to defects in the final product. Typically, the edge portions of the fiber are vacuumed away to render relatively clean cut edges of the batt. While the fiber is recovered to be subsequently reformed into the web, the inability to utilize the full width of the manufacturing capability has reduced the productivity of the system.

Upon investigation, it has been hypothesized that the air flow which carries the fiber to the screen conveyor has vortices or turbulence at the peripheral sides which renders the unsatisfactory product. In accordance with Zafiroglu, the air that is used to carry the fiber is introduced through a system of large conduits and fans. Prior to receiving the fiber, the air flow is directed through screens and straighteners to provide a uniform flow substantially free of large-scale turbulence and vortices. Thereafter, the large volume, relatively slow moving air flow is accelerated through a converging section or nozzle into a reduced cross sectional area conduit which is substantially flat and wide to be suited for laying down a wide web. It is believed that the Zafiroglu designed acceleration nozzle creates, or allows the creation of, the vortices and turbulence at the peripheral sides which is believed responsible for the edge defects.

Accordingly, it is an object of the present invention to provide an airlay web former arrangement which substantially reduces the edge defects of the web and overcomes the drawbacks of the present arrangements as described above.

It is a more particular object of the present invention to provide an arrangement for accelerating an airstream for an airlay web former which provides a substantial improvement over present designs in avoiding the creation or development of large scale turbulence and vortices.

The above and other objects of the invention are achieved by the provision of an acceleration device which comprises a duct having a generally rectangular cross sectional inlet portion having generally flat straight portions at all of the top, bottom and sides thereof and a generally rectangular cross sectional outlet portion having generally flat straight portions at all of the top, bottom and sides thereof. The cross sectional area of the outlet portion is smaller than the cross sectional area of the inlet portion. The device further comprises an acceleration portion between the inlet and outlet portions wherein all of the top, bottom and sides converge inwardly from the cross sectional shaped inlet portion to the cross sectional shaped outlet portion.

The invention may also be characterized by the converging portions of the device having a shape wherein the converging portions have a continuously differentiable curvature.

BRIEF DESCRIPTION OF THE DRAWINGS

Some of the objects of the invention have now been stated and others may become apparent as the description of the invention proceeds. The invention may be more easily understood by reference to the accompanying drawings in which.

DETAILED DESCRIPTION OF THE PREFERRED EMBODIMENT

Figure 1:
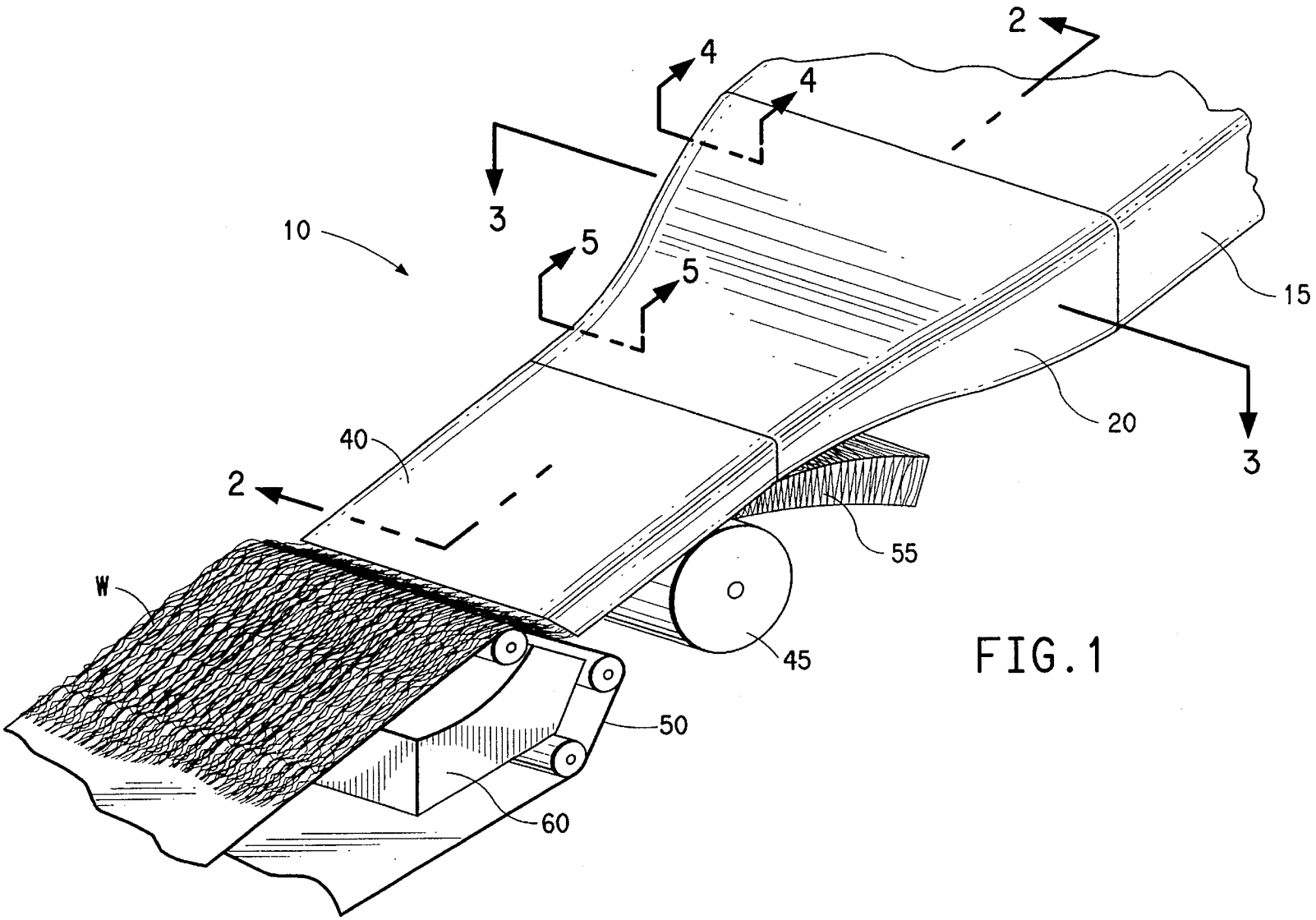
FIG. 1 is a perspective view of a preferred embodiment of an airlay web former including an improved air acceleration arrangement which is at the heart of the present invention.

Turning now to FIG. 1, an airlay web former is generally indicated by the number 10. More detailed descriptions of arrangements for airlay web formers are set forth in U.S. Pat. Nos. 3,768,120 (Miller) and 3,797,074 (Zafiroglu), which are hereby incorporated by reference herein. The web former 10, as illustrated, utilizes a flow of air which is provided through a duct 15. Within the duct 15, as is more clearly shown in FIG. 2, there are included filters 16 and straighteners 17 to eliminate or substantially reduce large-scale turbulence and vortices that may have been created by a fan or impeller or by the duct work, etc. The air flow through the duct 15 is preferably rather slow to permit effective straightening thereof. Accordingly, the duct 15 has a rather large cross section to permit a large volume of air to move slowly therethrough.

An acceleration arrangement 20 (sometimes referred to as a nozzle) is connected to the end of the duct 15 and has a reducing cross section to increase the velocity of the air passing therethrough. The particulars of the acceleration arrangement 20 will be described in more detail below.

An airlay duct 40, which has a size corresponding to the outlet of the acceleration arrangement 20, is connected to the end of the nozzle which is arranged to convey the air flow along a path which accepts the fiber to be laid into a web and lay down the fibers. The airlay duct 40 is arranged in conjunction with a disperser roll 45 which feeds fibers from a batt 55 into the air stream. The fibers are carried down the airlay duct 40 to a screen conveyor belt 50 and deposited thereon to form the web W. The air which carries the fiber preferably passes through the foraminous belt 50 and is collected in the collection duct 60. The collection duct 60 carries the air out of the airlay equipment to be vented to the atmosphere or recycled to lay more fiber.

Figure 2:
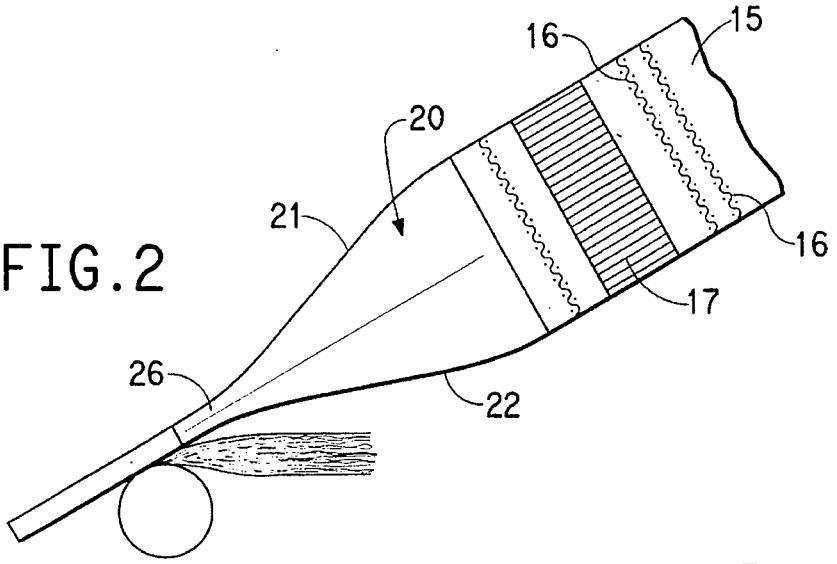
FIG. 2 is a fragmentary cross sectional view of the air acceleration arrangement taken along line 2—2 of FIG. 1.
Figure 3:
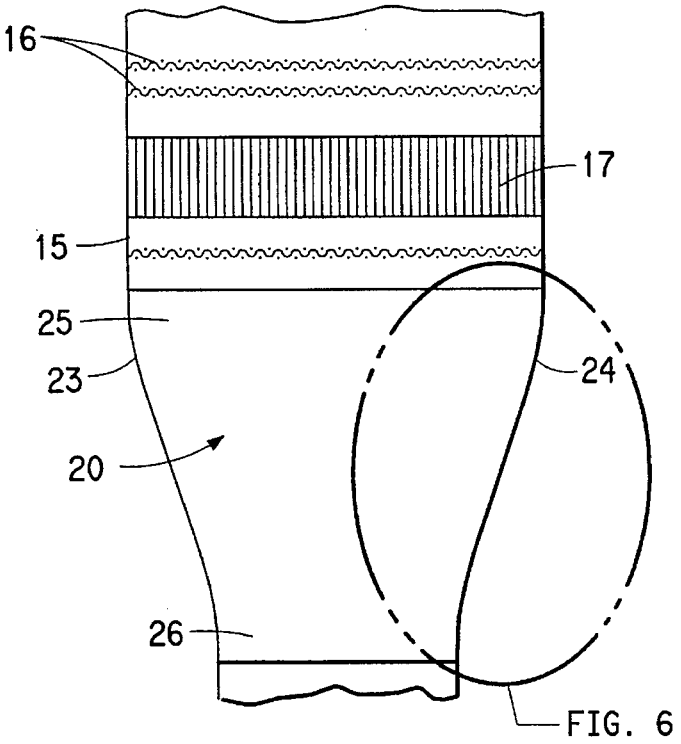
FIG. 3 is a fragmentary cross sectional view of the air acceleration arrangement taken along line 3—3 of FIG. 1.

Turning now to the particulars of the acceleration arrangement 20 in FIGS. 2 and 3, the nozzle comprises top and bottom panels 21 and 22 and opposite side panels 23 and 24. The acceleration arrangement 20 has an inlet end 25 connected to the conduit 15 and an outlet end 26 connected to the airlay duct 40. The nozzle is preferably formed of galvanized sheet metal which is welded along the seams. The preferred arrangement also includes external reinforcement, which is not shown for illustration purposes, for reducing the flexing of the panels. Clearly, there are many useful materials and construction techniques which could be used to construct the invention, as would be apparent to those skilled in the art of manufacturing air ducts and other similar industrial equipment.

Since the acceleration arrangement 20 forms the nucleus of the present invention there are several features thereof that should be highlighted. For example, the acceleration arrangement 20 is arranged to have a discharge end 26 that is smaller in both width and height than it is at its inlet end 25. In the prior arrangement, the width dimension remained the same while the height dimension alone was substantially reduced. In addition, the specific contours of the top, bottom and side walls 21, 22, 23, and 24 of the acceleration arrangement 20 have been substantially engineered and refined to reduce the creation of large-scale turbulence and vortices. In particular, the contours are arranged to be curving such that the curvature is continuously differentiable between the ends. Another feature worthy of being highlighted is that the seams at which the walls intersect are provided with fillets to provide a smoother surface along which the air can move. In the preferred arrangement, the fillets gradually increase in dimension from the inlet to the outlet end of the nozzle.

The first highlighted feature is that all of the panels 21, 22, 23, and 24 are inwardly curving to reduce the dimension from the inlet to the outlet in both width and height as is best illustrated in FIGS. 1, 2 and 3. This is quite in contrast to the prior arrangement which has straight and parallel side panels such that only the vertical dimension of the conduit is reduced. In the preferred embodiment, all the panels deviate or converge approximately the same amount or dimension: however, it is certainly not necessary that the side panels 23 and 24 converge to the same degree as the top and bottom panels 21 and 22. It is not certain how much the lateral convergence of the nozzle in addition to the vertical convergence has contributed to the success of the present design, but since most of the improvement in the new design has focused on the lateral edges of the wide fibrous web formed by the airlay process, it is believed that this is an important feature of the present invention.

Figure 6:
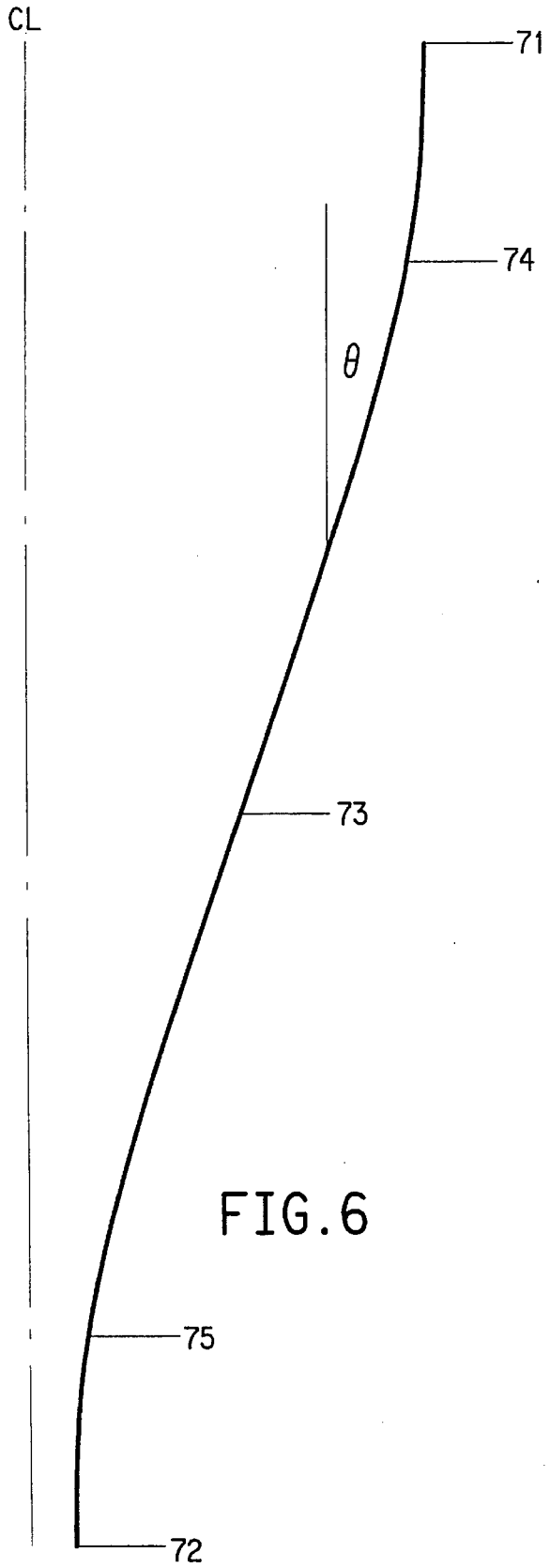
FIG. 6 is an enlarged fragmentary view of the area defined by oval 6 in FIG. 3 particularly to illustrate the contour of the side wall of the acceleration nozzle of the present invention.

The second highlighted feature of the new arrangement is that the panels have a contour which has a continuously differentiable curvature between it ends. Continuously differentiable curvature is a curve that has a particular smoothness or that changes curvature gradually. The present invention has a continuously differentiable curvature and is best illustrated in FIG. 6 where it is enlarged compared to the other drawing figures.

Continuously differentiable curvature may be more easily understood when considered mathematically. Curvature for an algebraically defined curve is generally calculated by the following formula:

$$K(x) = \frac{\left|\frac{d^2y}{dx^2}\right|}{\left(1+\left(\frac{dy}{dx}\right)^2\right)^{3/2}}$$

wherein:

K(x) = the curvature of the curve as a function of a position x along a reference line.

$\left|\frac{d^2y}{dx^2}\right|$ = the absolute value of the second derivative of an algebraically defined curve.

$\frac{dy}{dx}$ = the first derivative of an algebraically defined curve.

Figure 7:
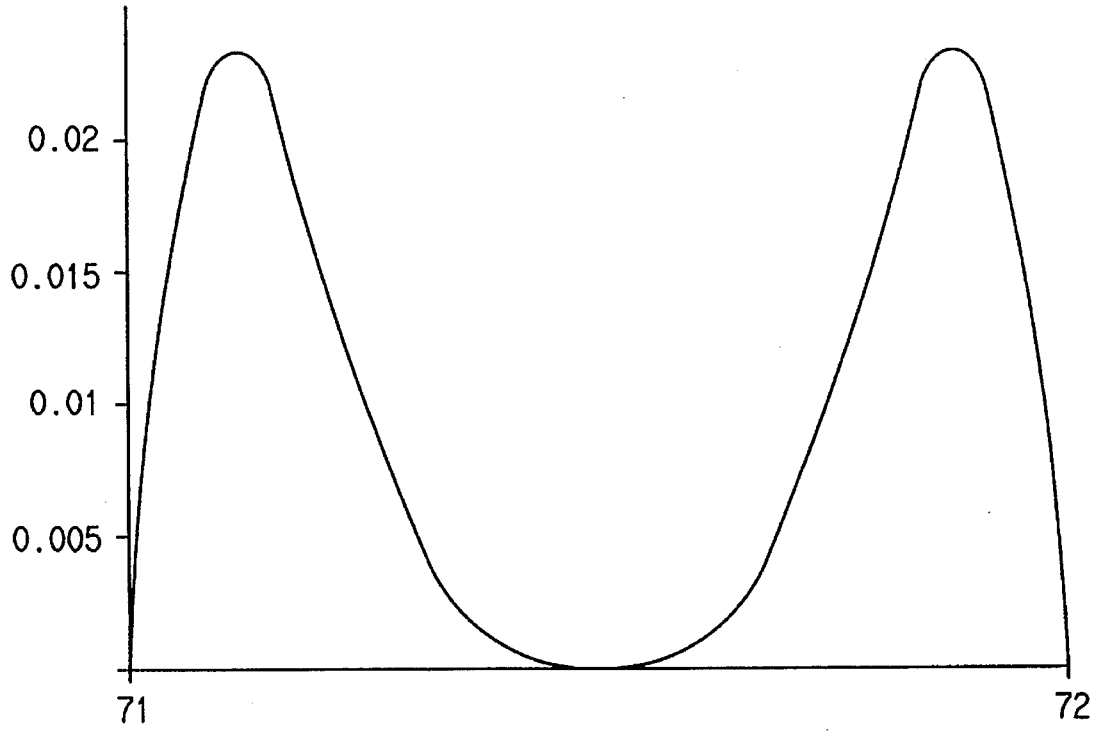
FIG. 7 is a graphical representation of the curvature of the side wall of the acceleration nozzle.

It is noted that the curve is most easily considered if it is a simple algebraically defined curve. However, the first and second derivatives may still be determined at various points along the curve and thus the curvature may be plotted therefrom. Considering a plot of the curvature as seen in FIG. 7, and comparing it to the contoured panel as seen in FIG. 6, it should be seen that a continuously differentiable curve does not have abrupt changes in curvature. The contour or curve of the panels of the present invention can be described as having several key areas. Consider first, the end points 71 and 72. At the first end point 71, the angle θ is zero so that the panel is essentially parallel to the corresponding wall of the conduit 15. The curvature is also zero as seen in FIG. 7. From the end point 71, the curvature of the panel then increases rapidly to a peak at a first maximum curvature point 74. By referring now to the plot in FIG. 7, a peak curvature should be noted at the left portion of the plot which would be associated with the curvature of the first maximum curvature point 74. The curvature of the panel thereafter begins to decrease. At about a midpoint 73, the panel reaches an inflection where the curve changes to the opposite direction. This is about where the maximum angle θ of the panel is achieved and where the curvature will equal zero.

As should be particularly noted in the plot in FIG. 7, the curvature smoothly decreases or settles to a value of zero at the inflection point 73 rather than an abrupt change to zero curvature. This smooth or gradual change in curvature is a significant feature of the present invention. The plot indicates that the curvature gradually increases again after the inflection in a manner similar to the way the curvature decreased to zero. Again, this is the continuously differentiable curvature. As noted above, the contour has a certain symmetry which is best illustrated in the plot of the curvature. The maximum curvature is again attained at a second maximum curvature point 75 before decreasing to zero curvature at the end point 72. Also at the end point 72, the angle θis equal to zero so that the panel is essentially parallel to the corresponding wall of the airlay duct 40.

As such, continuously differentiable curvature should be understood to mean that the curvature changes gradually or that a plot of the curvature of the curve would not have abrupt changes. It is believed that a conveyor nozzle having continuously differential curvature panels provide for continuously varying boundary pressure from the inlet portion to the outlet portion.

The feature of the symmetry referred to above, may be best seen for the panel by considering that it may be rotated end for end about an axis extended transversely through the inflection point 73 such that the end point 72 would be in the position of the first end point 71.

One feature that is probably not very apparent from the drawings or from the plot of the curvature, but which is also believed to substantially contribute to the minimization of large-scale turbulence and vortices, is the maximum angle of the panel to the centerline. In the prior arrangements the maximum angle θwas approximately 25 degrees. In the present invention, the maximum angle is about 16.7 degrees. As such, the lower slope provides a more gradual acceleration of the air flow while still providing a curved transition at the inlet and outlet ends 25 and 26 of the nozzle. It is recognized that the curvature is greater near the ends of the panels (as shown by the high peaks in the curvature in the plot in FIG. 7), but this apparently does not offset the better performance of the lower slope.

In the prior existing arrangement, the contour of the top and bottom panels is a combination of a straight section which converges toward the centerline with curved transition portions at the inlet and outlet ends. The transition portion from the straight inlet end is more dramatic (greater curvature) than the more gradual transition back to the straight outlet end (less curvature). This provided a greater angle θbetween the panel and the centerline of the prior existing nozzle.

The curve of the panel of the preferred embodiment of the present invention has been defined mathematically by a seventh order polynomial equation such as illustrated as follows:

$$y=ax^7+bx^6+cx^5+dx^4+ex^3+fx^2+gx+h$$

By defining the location of the end points, the angle θ of the end portion of the panels being zero, the curvature of the end portions being zero, and the curve being symmetrical about its transverse axis, the coefficients of seventh order polynomial can be determined. Since the end points are defined by the particular installation which will be defined by the needs of the particular airlay system, the coefficients of the polynomial equation will be different although the various curves will have a rather similar appearance. In the present invention, the non zero value of "a" in the above seventh order polynomial, in large part, provides the gradual changes in curvature at the inflection point.

Figure 4:
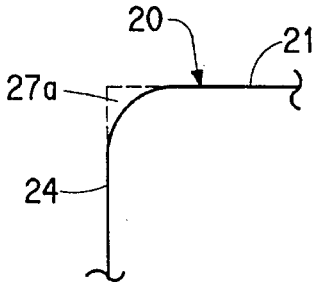
FIG. 4 is an enlarged fragmentary view of the air acceleration arrangement taken along FIG. 4—4 of FIG. 1.
Figure 5:
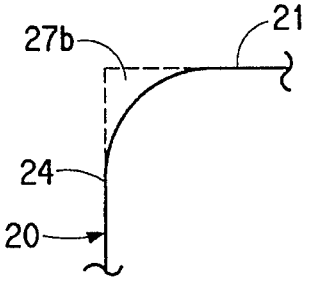
FIG. 5 is an enlarged fragmentary cross sectional view of the air acceleration arrangement taken along FIG. 5—5 of FIG. 1.

The fillets 27 are provided to further alleviate potential causes of large-scale turbulence and vortices. As noted above, the prior existing nozzle design provided for the panels to intersect in sharp perpendicular seams. In the preferred embodiment the fillets 27, which are essentially concave chamfers inside the duct, are provided to grow or increase in size from the inlet end 25 toward the outlet end 26. Thus, the fillets 27 have a smaller radius near the inlet 25 and a larger radius nearer to the outlet 26. The fillets are generally indicated by the number 27, but are indicated **27*a* and 27*b* in FIGS. 4 and 5 to show how the fillets are larger nearer the outlet end 26. In accordance with this preferred arrangement, the airlay conduit 40 may also be provided with fillets that correspond in size to the fillets 27*b*** near the intersections of the nozzle and the airlay conduit.

The foregoing description is intended to provide a clear understanding of the invention and not to limit the scope of protection provided by any patents issued for this invention. The scope of the invention is set forth in the following claims.

We claim:

1. A web forming installation for forming a web on a moving screen conveyor, the installation comprising:

a fan for creating a flow of air;

first large size ducting connected to said fan for carrying said flow of air;

means associated with said large size ducting for reducing large scale turbulence and straightening said flow of air;

second smaller size ducting associated with said first large size ducting for receiving said air flow from said large size ducting, said second smaller size ducting having a smaller cross section compared to said first large size ducting;

a fiber disperser associated with said second smaller size ducting for dispersing fiber into said air flow in the second smaller size ducting;

an acceleration device connected between said first large size ducting and said second smaller size ducting for accelerating said flow of air after said flow has been straightened and prior to fiber being dispersed therein, the acceleration device including opposite top and bottom walls and opposite side walls joined at their intersecting edges, an inlet end and an outlet end wherein said inlet end is connected to said first large size ducting and wherein the inlet end is substantially flat and straight at all of its top, bottom and sides thereof and is substantially the same cross section size as said first large size ducting, said outlet end is connected to said second smaller size ducting and wherein the outlet end is substantially flat and straight at all of its top, bottom and sides thereof and is substantially the same cross section size as said second smaller size ducting, and wherein at least two of said walls of said acceleration device which are opposite from one another converge toward one another in a curving manner between said inlet and outlet ends wherein said opposite curving walls have a continuously differentiable curvature over their entire length including the flat and straight inlet and outlet ends.

2. The installation according to claim 1 wherein the joints at the edges of said walls are provided with a fillet to smooth the air flow along the joints.

3. The installation according to claim 2 wherein the fillets have a smaller radius nearer the inlet end and a larger radius near the outlet end and the change in radius is gradual along the length of the joints.

4. The installation according to claim 1 wherein all of said walls of said acceleration device converge inwardly in a curving manner and the curvatures of the walls are continuously differentiable over their entire lengths including the flat and straight inlet and outlet ends.

5. The installation according to claim 4 wherein the inwardly curving opposite side walls and inwardly curving opposite top and bottom walls have substantially the same curvature.

6. The installation according to claim 5 wherein the curvature of said walls is substantially symmetrical about an inflection point about midway from the inlet end to the outlet end.

7. The installation according to claim 1 wherein the curvature of the inwardly converging walls may be defined by a polynomial equation of at least the seventh order.

8. A process for accelerating an air stream from a relatively slow velocity to a relatively higher velocity which is suitable for carrying a generally continuous feed of a plurality of fibers from a disperser, through air lay duct and onto a screen conveyor to form a web of dry fibers thereon wherein the air stream is substantially devoid of large scale turbulence and vortices, the process comprising the steps of:

filtering the air stream as the air moves at a relatively slow velocity through a relatively large cross sectional area duct;

channeling the relatively slow moving air stream to create a substantially linear flow air stream in the relatively large cross sectional duct;

directing the air stream into an acceleration nozzle which has a decreasing cross sectional dimension along its length to cause the air stream to increase in velocity, wherein the cross sectional area for the air stream converges in both lateral dimensions and the convergence follows a path which includes generally flat and straight portions at the ends thereof and a curve which is continuously differentiable along it entire length including the flat and straight ends.

9. The process according to claim 8 wherein the step of directing the air stream into an acceleration nozzle further comprises directing the air stream into a nozzle such that the converging lateral dimensions converge in all of the top, bottom and side dimensions thereof and follow a path having flat and straight portions at the ends thereof and a curve between the ends which is continuously differentiable along the entire length including the flat and straight ends.

* * * * *